US006316846B1

(12) United States Patent
Kashiwazaki et al.

(10) Patent No.: US 6,316,846 B1
(45) Date of Patent: Nov. 13, 2001

(54) CORD SWITCH AND PRESSURE SENSOR

(75) Inventors: Shigeru Kashiwazaki, Ibaraki; Hideki Yagyu, Ibaraki; Koji Horii, Ibaraki; Hidenori Ishihara, Shizuoka; Tomoyuki Kikuta; Takeshi Tanaka, both of Aichi, all of (JP)

(73) Assignees: Hitachi Cable, Ltd., Tokyo; Asmo Co., Ltd., Shizuoka, both of (JP)

( * ) Notice: Subject to any disclaimer, the term of this patent is extended or adjusted under 35 U.S.C. 154(b) by 0 days.

(21) Appl. No.: 09/443,887

(22) Filed: Nov. 19, 1999

Related U.S. Application Data

(6262) Division of application No. 08/875,742, filed as application No. PCT/JP96/03537 on Nov. 29, 1996, now Pat. No. 6,078,014.

(30) Foreign Application Priority Data

Dec. 4, 1995 (JP) ..... 7-315515
Dec. 20, 1995 (JP) ..... 7-331788

(51) Int. Cl.[7] ..... H01H 3/16

(52) U.S. Cl. ..... 307/119; 200/61; 200/85; 200/508; 200/509; 200/510; 200/511; 200/512

(58) Field of Search ..... 307/116, 119; 200/61.43, 61.44, 61.73, 61.81, 61.82, 85 R, 508, 511, 512, DIG. 10, DIG. 37; 49/26, 27, 28

(56) References Cited

U.S. PATENT DOCUMENTS 2,843,694 7/1958 Bertaux .
3,099,722 * 7/1963 Vila Gracia ..... 200/61.43
4,365,188 * 12/1982 Walter ..... 200/61.43
4,745,301 * 5/1988 Michalchik ..... 307/119
4,951,985 * 8/1990 Pong et al. ..... 200/61.43
5,459,962 10/1995 Bonne et al. .
5,481,076 * 1/1996 Mullet et al. ..... 200/61.43
5,774,046 * 6/1998 Ishihara et al. ..... 340/438
5,780,793 7/1998 Buchholz et al. .
5,801,347 * 9/1998 Tsuge et al. ..... 200/61.44
5,880,421 3/1999 Tsuge et al. .
6,078,014 * 6/2000 Kashiwazaki et al. ..... 200/61.43
6,166,338 * 12/2000 Ebato ..... 200/61.43

FOREIGN PATENT DOCUMENTS 36-17654 7/1961 (JP) .
36-28334 10/1961 (JP) .
39-4926 2/1964 (JP) .

* cited by examiner

*Primary Examiner*—Josie Ballato
*Assistant Examiner*—Cuevas R Rios
(74) *Attorney, Agent, or Firm*—McDermott, Will & Emery

(57) ABSTRACT

In order to provide a cord switch which can securely catch the ON/OFF operations, can cancel an erroneous operation by preventing the contact between electrodes caused by bending of the cord switch, and have a positive sensibility for the pressurization in all directions and a high reliability, at least two wire electrodes are spirally arranged along the inner surface of an insulator which is hollowed in the cross section and comprises a restorative rubber or plastic material in the longitudinal direction in a situation where the wire electrodes are not electrically contacted each other, and the wire electrodes are fixed to the hollowed insulator in a state where the wire electrodes are projected from the insulator.

2 Claims, 3 Drawing Sheets

CORD SWITCH AND PRESSURE SENSOR

This application is a Divisional of application Ser. No. 08/875,742, filed Jan. 16, 1998 now U.S. Pat. No. 6,078,014, which is a 371 of International Application No. PCT/JP96/03537, filed Nov. 29, 1996.

TECHNICAL FIELD

This invention relates to a cord switch carrying out the ON/OFF operation with a high accuracy in response to an external pressure an, and to a pressure sensor using such a cord switch.

BACKGROUND ART

According to the development of recent electronic apparatus, the automation of various machines and facilities has been advanced. Concomitantly, sensors of various kinds have more become necessary. For example, in an apparatus having an opening and closing member such as a door, cover and the like, the sensor is required for sensing an object or the hand of a human being caught into its opening when the opening and closing member is shut.

Previously, a sheet type of input switch or pressure sensor has widely been used, which is made by dispersing graphite or metal particles into silicone rubber to give conductivity and forming the mixture into a pressure sensitive and conductive rubber sheet. Such a prior art is disclosed in Japanese Patent Publication Nos. 40-24061: 57-53602; 56-54019: 58-24921; and Japanese Laid Open Patent Publication No. 53-897. Also, a cord-shaped switch or sensor having the long sheet sandwiched electrodes is described in Japanese Laid Open Patent Publication Nos. 61-161621; and 63-52024; and Rubber Industries, Vol. 21(1985), No.1.

Recently, a pressure sensor having a cavity between such conductive members to enhance a switching function and to ensure the ON/OFF operations is proposed in Japanese Laid Open Patent Publication No. 6-260054.

In recent years, to prevent an accident by which a part of the human body is caught by a window shield upon a motor-operated automatic opening and closing in an automobile, the development of a sensor to detect such a catch of the human body is urgently required. The use of such a prior sensor described in Japanese Laid Open Patent Publication Nos. 6-260054; 63-52024, etc. results in various problems in a sensing accuracy.

According to Japanese Laid Open Patent Publication No. 63-52024, a pressure is detected by the drop in electric resistance caused by pressurization, but change of electric resistance is too low. In addition, the electric resistance is changed by the internal stress generated within the sensor itself by bending thereof and the like, resulting in an erroneous operation of the sensor. According to Japanese Laid Open Patent Publication No. 6-260054. the disadvantage of the above low changed amount in electric resistance can be improved by providing a cavity between facing continuity members (electrodes), and detecting the pressure by means of contact between the continuity members caused by pressurization. However, this sensor has a serious defect in which the direction to be sensed is concentrated or biased in one direction, that is, it can not sense pressurization from the side. In addition, the facing electrodes easily come into contact each other in a bent condition and thus, this sensor can not be used in a curved portion.

It is therefore an object of the present invention to provide a cord switch which can securely detect and carry ON/OFF operations, can cancel an erroneous operation by preventing contact between electrodes due to their bending, and have a positive sensitivity to pressurization in all directions, that is, a high reliability. Also, it is an object of the present invention to provide a pressure sensor which can extend the sensing range to the leading edge of the cord switch.

DISCLOSURE OF THE INVENTION

The cord switch of the present invention is characterized in that A cord switch characterized in that at least two wire electrodes are spirally arranged along an inner surface of an insulator hollowed in cross section, which comprises a restorative rubber or plastic material, in a longitudinal direction wherein said wire electrodes are not electrically contacting each other; said wire electrodes are fixed to said hollowed insulator in a state where said wire electrodes are projected from said insulator, and said wire electrodes have a spiral lead length L in a range from $N\phi$–25 $N\phi$. (wherein N represents the number of the wire electrodes, and $\phi$ represents an inside diameter of a circle inscribed by the wire electrodes arranged spirally).

BRIEF DESCRIPTION OF THE DRAWINGS

In order that the invention may be more readily understood and put into practical effect, reference will now be made to the accompanying drawings which illustrate a preferred embodiment of the invention and wherein.

BEST MODE FOR CARRYING OUT THE INVENTION

Figure 1:
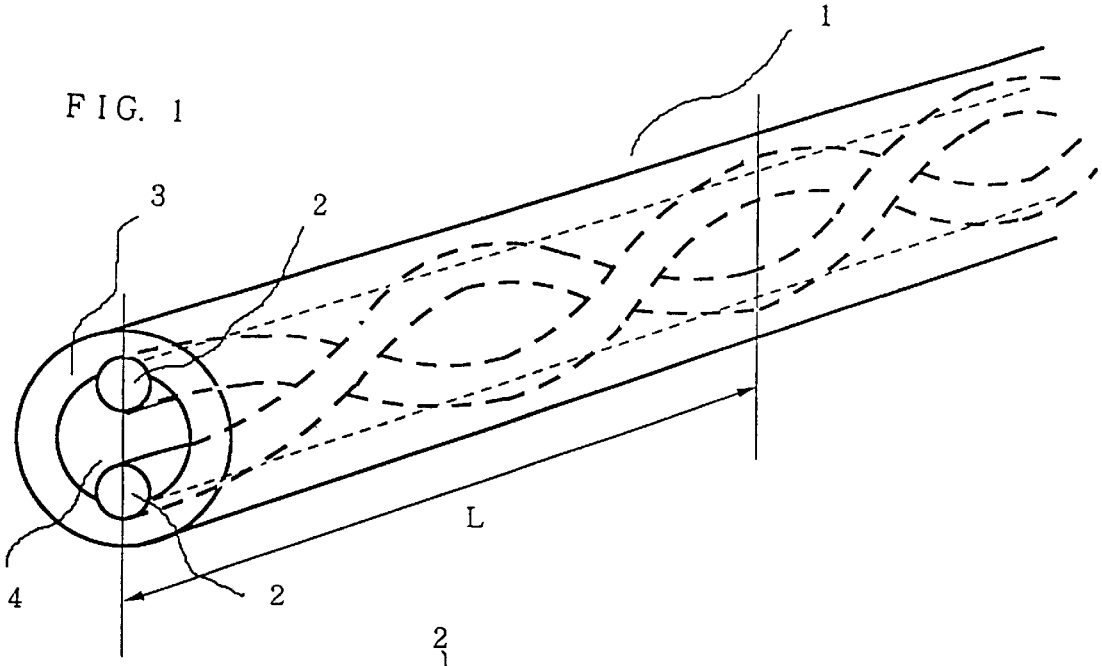
FIG. 1 is a perspective view of one preferred embodiment of the cord switch of the present invention.
Figure 2:
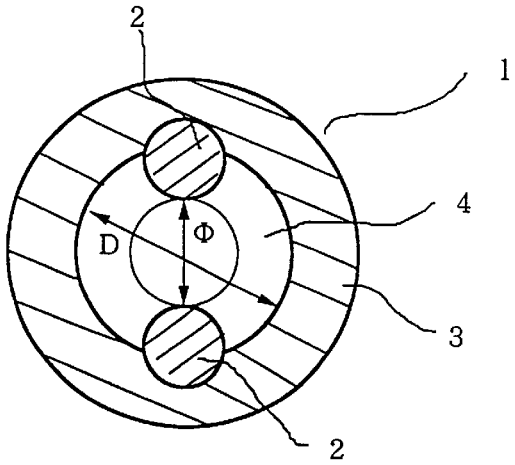
FIG. 2 is a cross-sectional view of the cord switch shown in FIG. 1.

As shown by a perspective view of FIG. 1 and a cross-sectional view of FIG. 2, a cord switch 1 according to the present invention comprises a pair of wire-type electrodes 2, an insulator 3 hollowed in cross-section and a cavity 4. The pair of wire electrodes 2 are spaced apart from one another at a prescribed interval and are spirally arranged along the inner surface of the hollowed insulator 3 made of a restorative rubber or plastic material in the longitudinal direction thereof.

Figure 3:
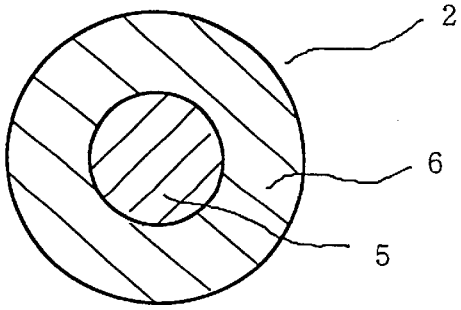
FIG. 3 is a cross-sectional view of one preferred embodiment of a wire electrode of the present invention.

The hollowed insulator 3 has the pair of wire electrodes 2 held and fixed on the inner surface thereof and not in contact with each other, easily deformed by an external force, and restored as soon as the force is removed therefrom. The restorative rubber to form the hollow insulator 3 includes silicone rubber, ethylene propylene rubber, styrene-butadiene rubber, chloroprene rubber, and the like. The restorative plastics includes polyethylene, ethylene-vinyl acetate copolymer, ethylene-ethyl acrylate copolymer, ethylene-methyl methacrylate copolymer, polypropylene, poly(vinyl) chloride, polyolefin or styrene thermoplastic elastomer and the like. In addition, even engineering plastics such as polyimide, polyamide, or the like, they can be used by devising their shape, thickness and lamination with other materials. Although the wire type electrode 2 generally consists of a metal conductor such as copper wire, copper alloy etc., it is preferred to use a metal stranded wire made by stranding a plurality of metal wires to provide its improved flexibility and restorativeness. In addition, in order to increase the restorativeness and the force for holding and fixing the wire electrode 2 by the hollowed insulator 3, preferably, the wire electrode 2 has a conductive rubber or plastic layer 6 coated on the outer periphery of the electrode 2 as shown in FIG. 3. The conductive rubber or plastic layer 6 can be formed by extruding an intimate mixture on the outer periphery of the metal conductive wire 5 to form the coating thereon. The intimate mixture can be obtained by blending a filler such as carbon black, etc. into the restorative rubber or plastics to form the above hollowed insulator 3. Preferably, the rubber or plastic layer 3 has a cross-sectional area twice or more that of the metal conductive wire 5. This can give a sufficient elasticity to the wire electrode 2 as well as the ability of the hollowed insulator 3 sufficient to hold and fix the wire electrode 2 thereby providing a large restorative force to the wire electrode 2.

Also, in order to prevent erroneous operation caused by bending of the hollowed insulator 3, it is preferred to select the spiral lead length L(L set forth one pitch or cycle of the electrode 2) of the wire electrode 2 in the range of $N\phi$–$25N\phi$ (N represents the number of the wire electrodes 2 and $\phi$ represents the diameter of a circle inscribed in the pair of wire electrodes 2) and more preferably, $2N\phi$–$10N\phi$. When the value of L is less than that of $N\phi$, the insurance of the space necessary to keep the insulating properties between the pair of wire electrodes 2 tends to become difficult, and when the value of L exceeds that of $20N\phi$, the buckling caused by the bending tends to develop thereby resulting in erroneous operation of the cord switch 1.

Further, the wire electrode 2 may spirally be wound only in one direction throughout the entire length of the cord switch 1, but the direction of the spiral winding also can be reversed on the halfway of cord switch 1. In order to make sure of the easy contact between the wire electrodes 2 by pressure from any direction in the cross section of the hollowed insulator 3, they are embedded into the hollowed insulator 3 and fixed therein in the situation where a part of each of the wire electrodes 2 is projected radially inwardly into the cavity 4. The projected amount of the respective wire electrodes is preferably 5% or more of the inside diameter of the hollowed insulator 3 and more preferably, 10% or more thereof. When it is less than 5%, the wire electrodes 2 might contact each other depending on the direction of applied pressure. One concrete example of the projected amount is 0.3 mm or more and more preferably, 6 mm or more when the inside diameter of the hollowed insulator 3 is in the range of from 1.5 mm to 5 mm.

Further, by increasing the number of the wire electrodes 2, for example, 3, 4, 5, 6, etc., the pressure responsiveness in respective modes can be enhanced. The number of the wire electrodes 2 is generally even. In this case, it is concomitantly important to design the mechanical properties such as the outside diameter or the spiral lead L of the wire electrode 2, the outside diameter of the sensor 1, the thickness of the hollowed insulator 3, the elastic modulus of the hollowed insulator 3 and electrode and the like, depending on the target performance for an cord switch 1. For example, the increase in the number of the electrode on the circumference of the inner circle in the cross section of the hollow insulator 3 may enable the paired electrodes 2 to contact each other even the amount of deformation in cross section of the insulator 3 becomes more small, thereby enabling the reduced amount of projection of the electrode 2 to provide a similar pressure responsiveness to that of the increased amount of projection. On the other hand, a decreased number of the electrodes 2 is preferred in the respects of the thinner sensor or cord switch 1, arrangement of an acute-angled curved portion, reduction in the number of connection processes for the wire electrodes 2 and the like. In this way, the present invention can provide a high-performance sensor suitable for all objects by selecting a appropriate construction of the sensor.

Figure 4:
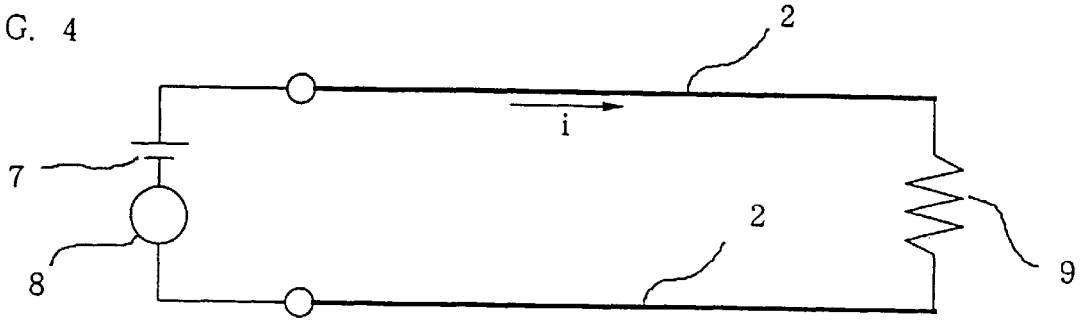
FIG. 4 shows a circuit diagram of the pressure sensor of the prior art.

The present invention can provide an important effect in safety in the case where the number of the wire electrodes is 4n ("n" represents an positive integer). FIG. 4 shows a schematic view of a pressure sensor in a case of two wire electrodes. In FIG. 4, a power supply 7 and an ammeter 8 are connected to one respective ends of the wire electrodes 2, a current controlling resistor 9 is connected to other respective ends thereof. A weak monitoring current "i" is normally applied to this circuit and a short-circuit current flows through this circuit when the wire electrodes 2 are in contact with each other by applying an external pressure to the wire electrodes 2, so that one can detect the abnormality, based on this increase in current. As described above, when the pressure sensor has the resistor 9 inserted between the wire electrodes 2 in the other end thereof, the portion having the resistor 9 attached can not have the function as a sensor. In addition, the influence such as increase in the outside diameter of the sensor and the like caused by attaching the resistor 9 is unavoidable. In this way, the detecting system by two wire electrodes 2 has a large restrictive factor in mounting the sensor in the case of detecting the hand caught into the opening of a motor vehicle window shield caused by a motor-operated switching device.

Figure 5:
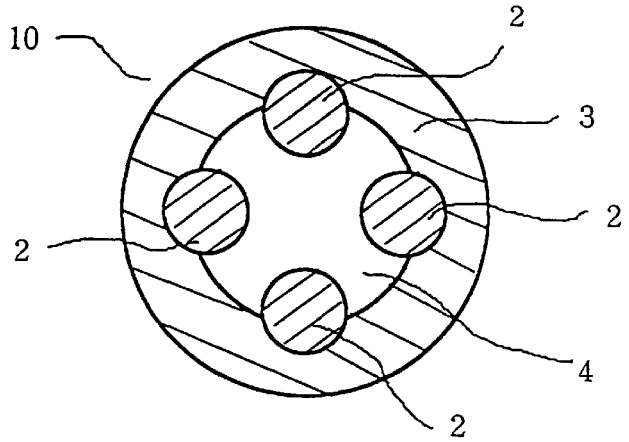
FIG. 5 is a cross-sectional view of a second preferred embodiment of the cord switch of the present invention.
Figure 6:
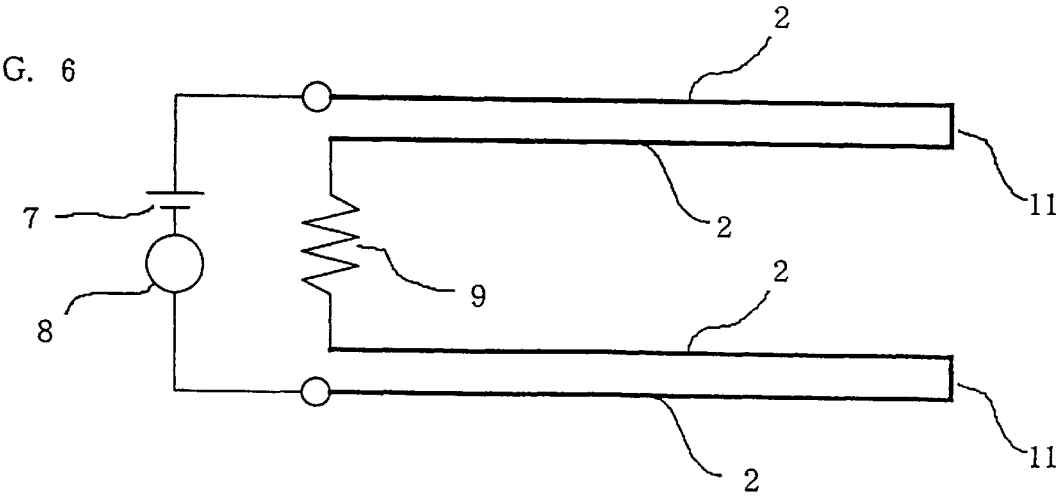
FIG. 6 shows a circuit diagram of one preferred embodiment of the pressure sensor of the present invention.

FIG. 5 shows a cord switch 10 having four wire electrodes 2, of which basic construction is the same as that of the cord switch 1 shown in FIG. 1. In FIG. 6, a power supply 7 and an ammeter 8 are connected between two wire electrodes 2 and a resistor 9 is connected between other two wire electrodes 2 in one end thereof, and the wire electrodes 2 are connected each other in the other end, resulting in a serial circuit comprising the power supply 7, the ammeter 8, the wire electrode 2 and the resistor 9. The pressure sensor 10 having such a construction can have the sensor function even in the end portion thereof.

EXAMPLE

A variety of cord switches having a spiral construction are manufactured by coating a conductive rubber compound(of a volume resistivity of 5 ohm.cm) mixed with carbon black on the surface of a metal conductive wire(of the outside diameter of 0.38 mm) of consisting of 7 tinned stranded copper wires to form a wire electrode having the outside diameter ranging from 0.6 mm to 2.0 mm(a cross sectional ratio of the metal conductive wire/the conductive rubber layer ranging from 2.5 to 28), forming this wire electrode into a spiral wire, extruding ethylene propylene onto the outer periphery of this spiral wire to form a hollow insulator, heating both of the conductive rubber layer and the hollow insulator for crosslinking thereof to make a variety of cord switches.

Each of the items of the bending characteristics, responsibility of bent portion, responsiveness in the peripheral, radial direction, responsibility in non-parallel deformation and responsiveness at the positions in the longitudinal direction were evaluated on a variety of cord switches, and the results are tabulated. The evaluations are based on the following.

(1) Bending Characteristics:

The Bending tests of the cord switch having 10 mm and 30 mm radii were effected and the results were judged by the existence or absence of erroneous contact of sensor wire electrodes caused by buckling. The non-contact in the 10 mm bending is represented by mark "◎", the non-contact in the 30 mm bending is represented by mark "○", and the contact in the 30 mm bending is represented by mark "x".

(2) Responsiveness of Bent Portion:

The bending tests of the cord switch having 10 mm and 30 mm radii were effected by applying a pressure to the bent portion and the results were judged by whether ON/OFF operations were normally kept or not. A good operation in a 10 mm bending is represented by mark "◎", the good operation in a 30 mm bending is represented by mark "○", and the bad operation in the 30 mm bending is represented by mark "x".

Figure 7:
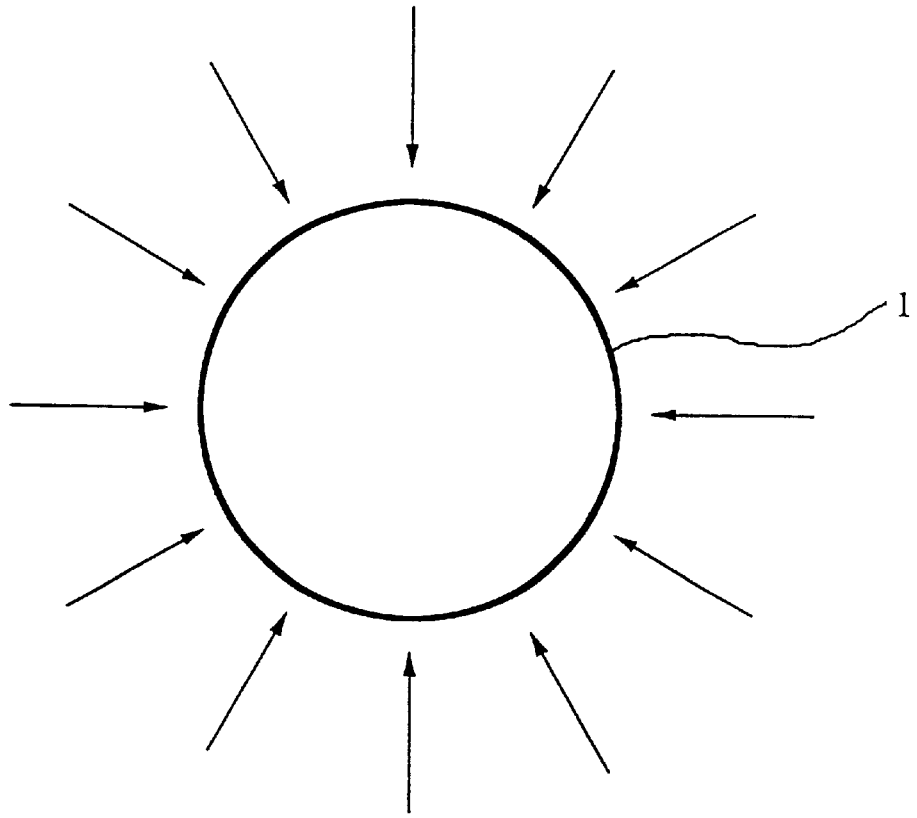
FIG. 7 is an illustrative view of a method for evaluating the responsiveness of the cord switch in the peripheral, radial directions of the cord switch.

(3) Responsiveness in the Peripheral, Radial Direction:

As shown in FIG. 7, the existence or absence of ON/OFF operations is judged by applying a pressure to the cord switch 1 in 24 radial directions at a 15° angle intervals in the cross section thereof. When all of the operations are good in all 24 directions, 24 points are given to the result and it is evaluated as 100%.

Figure 8:
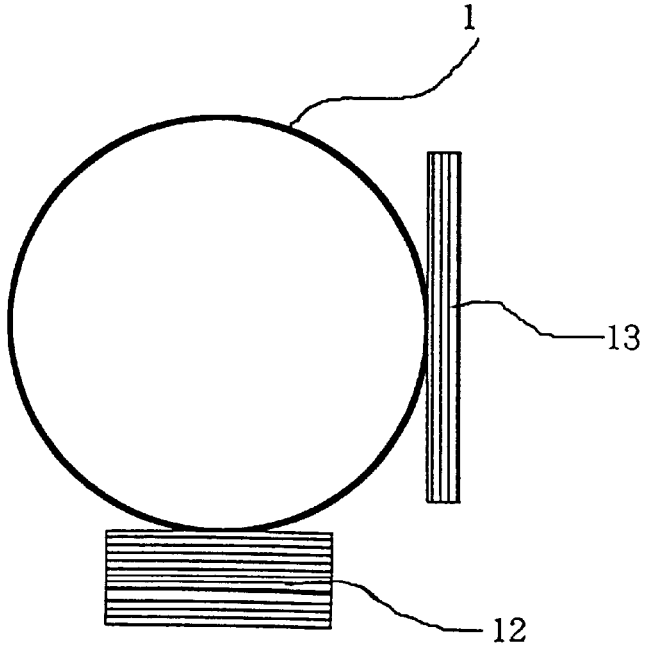
FIG. 8 is an illustrative view of a method for evaluating the resposibility of the cord switch to the non-parallel deformation.

(4) Responsiveness in Non-parallel Deformation:

As shown in FIG. 8, the responsible angles of ON/OFF operations were measured by fixing a part of the cord switch 1 to a stand 12, assuming a pressurizing angle parallel to the fixed plane of the stand 12 as "0°", and applying a pressure to the cord switch 1 with a round bar in a radial direction while changing the angle from this point at a 5° angle intervals.

(5) Responsiveness at the Positions in the Longitudinal Direction:

The ON/OFF operations were evaluated when the cord switch 1 was pressurized at arbitrary positions in longitudinal direction. The pressurization was effected using a cord switch having the wire electrode number ranging from 10N to 30N and a round bar having an outside diameter ranging from 4 mm to 200 mm. In the results, a good operation was evaluated by a mark "○", and an erroneous operation was evaluated by a mark "x".

The results are summarized in Tables 1, 2 and 3. It is clear that any cord switch of the present invention has excellent evaluated results on respective items of the bending characteristics, responsiveness of bent portion, resposibility in the peripheral, radial direction, responsiveness in non-parallel deformation and resposibility at the positions in the longitudinal direction.

TABLE 1

| | | Examples | Preferred embodiments | | | | | | |
|---|---|---|---|---|---|---|---|---|---|
| Items | | 1 | 2 | 3 | 4 | 5 | 6 | 7 | 8 |
| Hollowed insulator | O. D. (mm) | 6.0 | 6.0 | 6.4 | 5.9 | 6.0 | 5.9 | 5.8 | 5.7 |
| | Thickness of insulator (mm) | 1.1 | 1.1 | 1.3 | 0.9 | 1.0 | 0.7 | 0.8 | 0.4 |
| Wire Electrode | O. D. (mm) | 0.8 | 0.8 | 1.0 | 1.0 | 1.5 | 0.8 | 0.8 | 1.3 |
| | Number N | 2 | 2 | 2 | 2 | 2 | 2 | 4 | 4 |
| | Lead length L (mm) | 10 | 7.5 | 8.0 | 6.0 | 38.0 | 6.0 | 20.0 | 13.0 |
| | Nφ | 2.7 | 2.0 | 2.2 | 1.7 | 20 | 1.5 | 2.8 | 1.8 |
| | Projected amount (mm) | 0.1 | 0.5 | 0.6 | 0.8 | 1.1 | 0.6 | 0.2 | 0.9 |
| | (%) | 2.6 | 13.2 | 15.8 | 19.5 | 27.5 | 14.3 | 4.8 | 18.4 |
| Bending characteristic | | ◎ | ◎ | ◎ | ◎ | ○ | ◎ | ◎ | ◎ |
| Responsiveness of bend portion | | ○ | ○ | ○ | ○ | ○ | ○ | ○ | ○ |
| Responsiveness in the peripheral, radial direction (%) | | 100 | 100 | 100 | 100 | 100 | 100 | 100 | 100 |
| Responsiveness in nonparallel deformation (degrees) | | 30 | 60 | 70 | 80 | 85 | 70 | 70 | 90 |
| Responsiveness at the positions in longitudinal direction | | ○ | ○ | ○ | ○ | ○ | ○ | ○ | ○ |

TABLE 2

| | | Examples | Preferred embodiments | | | | | | |
|---|---|---|---|---|---|---|---|---|---|
| Items | | 9 | 10 | 11 | 12 | 13 | 14 | 15 | 16 |
| Hollowed insulator | O. D. (mm) | 5.8 | 5.5 | 5.8 | 5.2 | 6.6 | 6.0 | 6.2 | 4.0 |
| | Thickness of insulator (mm) | 0.4 | 0.7 | 0.8 | 0.7 | 0.9 | 0.9 | 0.5 | 0.5 |
| Wire Electrode | O. D. (mm) | 0.8 | 1.1 | 1.1 | 1.0 | 1.0 | 0.8 | 0.8 | 0.8 |
| | Number N | 4 | 4 | 4 | 4 | 6 | 6 | 6 | 2 |
| | Lead length L (mm) | 8.0 | 30.0 | 50.0 | 25.0 | 30.0 | 24.0 | 20.0 | 7.0 |
| | Nφ | 1.2 | 4.0 | 6.5 | 3.0 | 2.3 | 2.2 | 1.8 | 2.8 |
| | Projected amount (mm) | 0.5 | 0.8 | 0.8 | 0.8 | 0.7 | 0.5 | 0.6 | 0.5 |
| | (%) | 10.0 | 19.5 | 19.0 | 21.1 | 14.6 | 11.9 | 11.5 | 16.7 |
| Bending characteristic | | ◎ | ◎ | ○ | ◎ | ○ | ○ | ◎ | ◎ |

TABLE 2-continued

| Examples | Preferred embodiments | | | | | | | |
|---|---|---|---|---|---|---|---|---|
| Items | 9 | 10 | 11 | 12 | 13 | 14 | 15 | 16 |
| Responsiveness of bend portion | ○ | ○ | ○ | ○ | ○ | ○ | ○ | ○ |
| Responsiveness in the peripheral, radial direction (%) | 100 | 100 | 100 | 100 | 100 | 100 | 100 | 100 |
| Responsiveness in nonparallel deformation (degrees) | 90 | 90 | 90 | 90 | 90 | 85 | 80 | 70 |
| Responsiveness at the positions in longitudinal direction | ○ | ○ | ○ | ○ | ○ | ○ | ○ | ○ |

TABLE 3

| Examples | | | Embodiments | | Comparatives | |
|---|---|---|---|---|---|---|
| Items | | | 17 | 18 | 1 | 2 |
| Hollowed insulator | O. D.(mm) | | 4.0 | 4.2 | 5.8 | 5.8 |
| | Thickness of insulator (mm) | | 0.5 | 0.4 | 0.8 | 0.7 |
| Wire Electrode | O. D.(mm) | | 0.8 | 0.8 | 1.1 | 3.0 (width) |
| | Number N | | 4 | 6 | 4 | 2 |
| | Lead length L (mm) | | 20 | 40.0 | 50.0 | ∞ (straight line) |
| | N ϕ | | 3.2 | 4.0 | 6.5 | — |
| | Projected amount | (mm) | 0.5 | 0.6 | 0 | 0 |
| | | (%) | 16.7 | 17.6 | 0 | 0 |
| Bending characteristic | | | ◎ | ◎ | ○ | x |
| Responsiveness of bend portion | | | ○ | ○ | ○ | x |
| Responsiveness in the peripheral, radial direction (%) | | | 100 | 100 | 100 | 40 |
| Responsiveness in non parallel deformation (degrees) | | | 85 | 85 | 10 | 20 |
| Responsiveness at the positions in longitudinal direction | | | ○ | ○ | ○ | ○ |

Industrial Applicability

As described above, the present invention can provide a cord switch which can surely respond to the situation where an object or a part of the human body is caught, and an erroneous operation never generates even a curved arrangement of the cord switch, and thus, the present invention has a very high industrial value.

What is claimed is:

1. A pressure sensor characterized in that a cord switch is used in which 4n wire electrodes (n represents a positive integer) are spirally arranged along the inner surface of an insulator hollowed in the cross section, which comprises a restorative rubber or plastic material, in the longitudinal direction in a situation where said wire electrodes are not electrically contacted each other, and said wire electrodes are fixed to said hollowed insulator in a state where the wire electrodes are projected from said insulator; in one end of said cord switch, a power supply is connected between said two wire electrodes, and a current adjusting resistor is connected between other two said wire electrodes; in other end of said cord switch, said wire electrodes are connected each other to form a serial circuit comprising said power supply, said current adjusting resistor and said wire electrodes.

2. A pressure sensor according to claim 1 wherein a part of said respective wire electrodes are embedded into said insulator hollowed in the cross section.

* * * * *